US007878009B2

(12) United States Patent
Doberstein et al.

(10) Patent No.: US 7,878,009 B2
(45) Date of Patent: Feb. 1, 2011

(54) COOLING UNIT WITH DATA LOGGING CONTROL

(75) Inventors: Andrew J. Doberstein, Hartford, WI (US); Thomas W. Rand, Cedarburg, WI (US)

(73) Assignee: U-Line Corporation, Milwaukee, WI (US)

( * ) Notice: Subject to any disclaimer, the term of this patent is extended or adjusted under 35 U.S.C. 154(b) by 928 days.

(21) Appl. No.: 11/681,989

(22) Filed: Mar. 5, 2007

(65) Prior Publication Data

US 2008/0059003 A1 Mar. 6, 2008

Related U.S. Application Data

(60) Provisional application No. 60/823,961, filed on Aug. 30, 2006.

(51) Int. Cl.
*G01K 13/00* (2006.01)
*F25B 49/00* (2006.01)
*G08B 17/00* (2006.01)

(52) U.S. Cl. ..... 62/129; 62/126; 62/127; 340/585

(58) Field of Classification Search ..... 62/125, 62/126, 127, 129; 236/51; 340/584, 585
See application file for complete search history.

(56) References Cited

U.S. PATENT DOCUMENTS 1,110,137 A 9/1914 Johnson
1,588,287 A 6/1926 Willmann
4,238,930 A 12/1980 Hogan et al.
4,387,578 A 6/1983 Paddock
4,404,522 A 9/1983 Pucciarello
4,481,787 A 11/1984 Lynch
4,531,375 A 7/1985 Zinsmeyer
4,852,359 A 8/1989 Mazotti
5,065,584 A 11/1991 Byczynski et al.

(Continued)

FOREIGN PATENT DOCUMENTS

JP 2004069246 A * 3/2004

(Continued)

OTHER PUBLICATIONS

U. S. Patent Office Notice of Allowance for U.S. Appl. No. 11/535,826, dated Apr. 17, 2009.

(Continued)

*Primary Examiner*—Chen-Wen Jiang
(74) *Attorney, Agent, or Firm*—Quarles & Brady LLP

(57) ABSTRACT

A cooling unit includes a cabinet with a cooling chamber, a refrigeration system including an evaporator mounted, a compressor, a condenser, and a controller for controlling the cooling unit. The controller has a memory, a processor and an output interface. The controller monitors at least one parameter of the cooling unit, logs in the memory data corresponding to the at least one parameter, and outputs the logged data via the output interface. The cooling unit can include a sensor that monitors a parameter that is logged in memory. The sensor can be a temperature sensor. The logged data can be compared to stored error conditions to detect whether an error condition has occurred. If an error condition has occurred, an error code is logged in memory and can be outputted via the output interface.

12 Claims, 11 Drawing Sheets

U.S. PATENT DOCUMENTS

| | | | | |
|---|---|---|---|---|
| 5,097,671 | A | 3/1992 | Jeong-Hun | |
| 5,115,643 | A | 5/1992 | Hayata et al. | |
| 5,129,237 | A | 7/1992 | Day et al. | |
| 5,212,621 | A | 5/1993 | Panter | |
| 5,216,893 | A | 6/1993 | Santacatterina | |
| 5,289,691 | A | 3/1994 | Schlosser et al. | |
| 5,455,743 | A | 10/1995 | Miyajima | |
| 5,460,006 | A | 10/1995 | Torimitsu | |
| 5,564,285 | A | 10/1996 | Jurewicz et al. | |
| 5,586,439 | A | 12/1996 | Schlosser et al. | |
| 5,662,213 | A | 9/1997 | Kattler et al. | |
| 5,715,689 | A | 2/1998 | Byczynski et al. | |
| 5,842,355 | A | 12/1998 | Kalis et al. | |
| 5,867,235 | A | 2/1999 | Hasegawa | |
| 6,035,385 | A | 3/2000 | Le Van Suu | |
| 6,058,731 | A | 5/2000 | Byczynski et al. | |
| 6,148,621 | A | 11/2000 | Byczynski et al. | |
| 6,553,774 | B1 * | 4/2003 | Ishio et al. | 62/126 |
| 6,656,360 | B2 | 12/2003 | Rohrbach et al. | |
| 6,817,200 | B2 | 11/2004 | Willamor et al. | |
| 7,062,936 | B2 | 6/2006 | Rand et al. | |
| 7,140,551 | B2 | 11/2006 | de Pauw et al. | |
| 7,228,704 | B2 | 6/2007 | Rand et al. | |
| 7,464,566 | B2 | 12/2008 | Rand et al. | |
| 7,556,207 | B2 | 7/2009 | Mueller et al. | |
| 7,573,701 | B2 | 8/2009 | Doberstein et al. | |
| 7,575,179 | B2 | 8/2009 | Morrow et al. | |
| 2002/0029575 | A1 | 3/2002 | Okamoto | |
| 2005/0115259 | A1 | 6/2005 | Ergarac et al. | |
| 2006/0021363 | A1 | 2/2006 | Mizukoshi | |
| 2006/0218958 | A1 | 10/2006 | Rand et al. | |
| 2007/0157643 | A1 * | 7/2007 | Athanasiou | 62/152 |
| 2007/0251257 | A1 | 11/2007 | Rand et al. | |
| 2008/0053119 | A1 | 3/2008 | Doberstein et al. | |
| 2008/0059003 | A1 | 3/2008 | Doberstein et al. | |
| 2008/0092566 | A1 | 4/2008 | Rand et al. | |
| 2008/0092567 | A1 | 4/2008 | Doberstein et al. | |
| 2008/0092569 | A1 | 4/2008 | Doberstein et al. | |

FOREIGN PATENT DOCUMENTS

| | | | | |
|---|---|---|---|---|
| JP | 2005127615 | A | * | 5/2005 |
| WO | WO 2005057302 | A2 | * | 6/2005 |

OTHER PUBLICATIONS

Response to Nov. 21, 2008 Non-Final Rejection for U.S. Appl. No. 11/535,826, dated Feb. 23, 2009.

U. S. Patent Office Non-Final Rejection for U.S. Appl. No. 11/535,826, dated Nov. 21, 2008.

U. S. Patent Office Final Rejection for U.S. Appl. No. 11/535,838, dated Jan. 19, 2010.

Response to Jun. 11, 2009 Non-Final Rejection for U.S. Appl. No. 11/535,838, dated Oct. 12, 2009.

U. S. Patent Office Non-Final Rejection for U.S. Appl. No. 11/535,838, dated Jun. 11, 2009.

Response to Oct. 16, 2009 Non-Final Rejection for U.S. Appl. No. 11/681,963, dated Jan. 19, 2010.

U. S. Patent Office Non-Final Rejection for U.S. Appl. No. 11/681,963, dated Oct. 16, 2009.

Response to Feb. 9, 2009 Non-Final Rejection for U.S. Appl. No. 11/681,963, dated Jun. 9, 2009.

U. S. Patent Office Non-Final Rejection for U.S. Appl. No. 11/681,963, dated Feb. 9, 2009.

U. S. Patent Office Final Rejection for U.S. Appl. No. 11/682,011, dated Mar. 8, 2010.

Response to Jul. 7, 2009 Non-Final Rejection for U.S. Appl. No. 11/682,011, dated Nov. 9, 2009.

U. S. Patent Office Non-Final Rejection for U.S. Appl. No. 11/682,011, dated Jul. 7, 2009.

* cited by examiner

FIG. 1
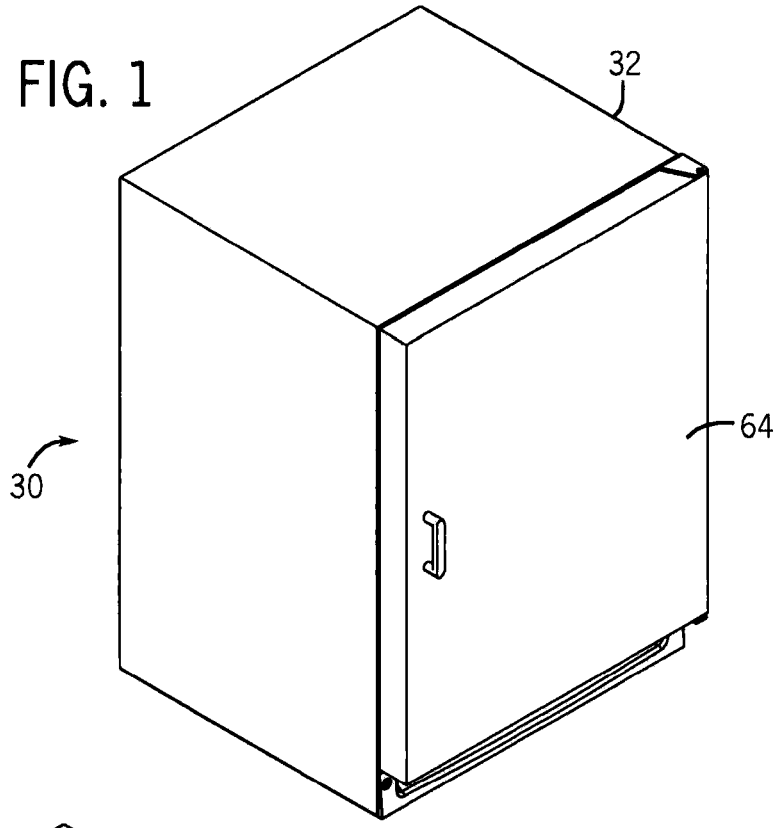
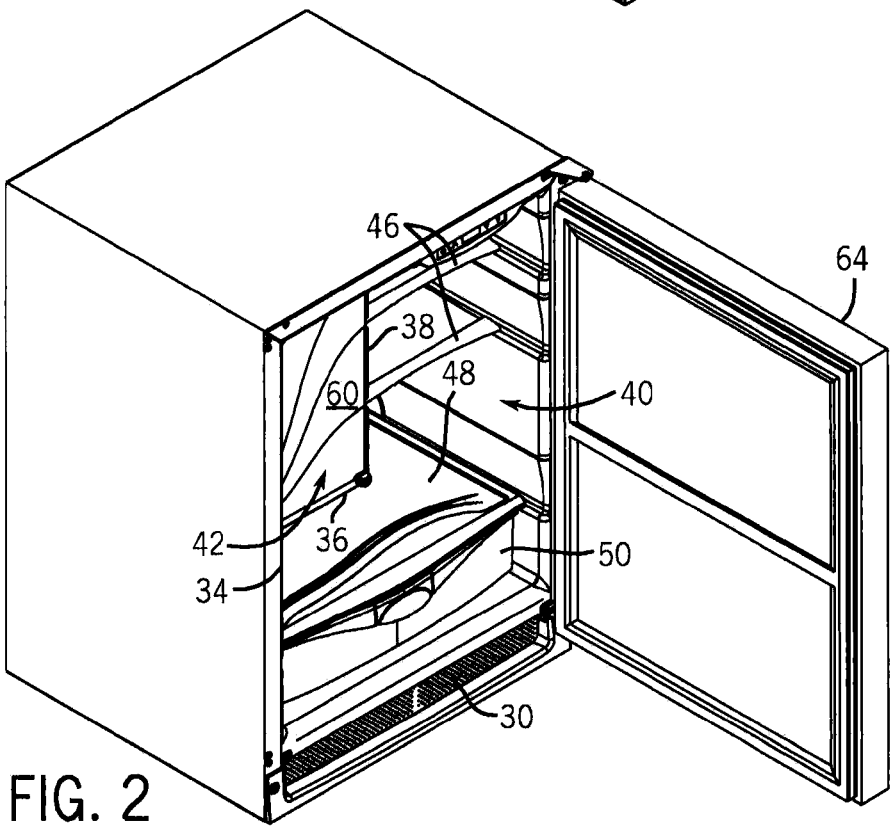
FIG. 2

208 210

| INPUT COMMAND | HOLD | TOUCH |
|---|---|---|
| VIEW ACTUAL TEMPERATURE (T1) | ∧ 202 | |
| VIEW ACTUAL TEMPERATURE (T2–T4) | ∧ ∨ 204 | |
| TOGGLE F – C | 206 | ∨ ∨ ∨ |
| TOGGLE SHOWROOM MODE | ∨ | |
| SERVICE MODE | ∧ | |
| DISPLAY TOGGLE | ∧ | |
| BLACKOUT MODE | | |
| CLEAN CYCLE | 200 | |
| ICEMAKER OFF MODE | | ∧ ∧ ∧ |
| FORCED HARVEST | | ∨ ∨ ∨ |
| FORCED REFRIGERATOR DEFROST | | |
| ICE THICKNESS ADJUSTMENT | ∧ | ∨ ∨ ∨ |
| TEMPORARY SHUTDOWN (OFFICE MODE) | ∨ | ∧ ∧ ∧ |
| RELAY STATUS | ∨ | |
| CHANGE MODEL NUMBER (WITH JUMPER) | ∧ ∨ | |

FIG. 14

COOLING UNIT WITH DATA LOGGING CONTROL

CROSS-REFERENCE TO RELATED APPLICATION

This application claims the benefit of U.S. Provisional patent application Ser. No. 60/823,961 filed on Aug. 30, 2006, and entitled "Cooling Unit," hereby incorporated by reference as if fully set forth herein.

STATEMENT OF FEDERALLY SPONSORED RESEARCH OR DEVELOPMENT

Not applicable.

BACKGROUND OF THE INVENTION

1. Technical Field

The present invention relates to refrigerated food and drink storage units, and in particular, to the user interface and operational control thereof.

2. Description of the Related Art

Refrigerators and coolers for the cold storage of food and beverages are well known and can come in full-size standup units or compact, under-counter units. Modern units typically have electronic controls for setting and regulating interior temperatures as well as for controlling ancillary features such as lighting, ice making and system monitoring functions.

Such controls are typically mounted inside the cabinet at a location attempting to make the user interface (control buttons, displays, etc.) readily accessible and visible to the consumer. However, it is often the case that the control interface is not user-friendly for the consumer.

One problem with such controls is that the user interface typically has very few input controls. This can be due to the need to keep the control physically small in size or to a small profile or footprint so as not to occupy significant space in the cooling compartment, especially true for compact, under-counter units. It can also be to present a clean interface with simple controls that is designed to reduce consumer confusion in operating the control.

Regardless of the reason, the down side of the control having limited input controls is that the user consequently has less control over the operation of the cooling unit. Operational control beyond the basic power on and temperature settings is thus largely unavailable in conventional cooling units.

This is especially problematic when servicing the cooling unit because the limited control and operational feedback of the unit make diagnosing the source of a problem difficult. Without adequate control of settings and sub-systems of the system the service technician may not be able to adequately isolate the failed component or system. The lack of historical operational feedback of systems of the unit further frustrate diagnostic efforts.

Accordingly, a control user interface for a cooling unit having expanded input control and diagnostic features is needed.

SUMMARY OF THE INVENTION

The present invention addresses the aforementioned problems and provides an improved cooling unit with data logging control.

Specifically, in one aspect the invention provides a cooling unit having a cabinet providing at least one cooling chamber therein, a refrigeration system and a controller for controlling the cooling unit. The refrigeration system includes an evaporator mounted within the cooling chamber, a compressor receiving return refrigerant from the evaporator, a condenser coupled to the compressor and to the evaporator through a restriction. The controller has a memory, a processor and an output interface. The controller is configured to monitor at least one parameter of the cooling unit, log in the memory data corresponding to the at least one parameter, and output the logged data via the output interface.

The cooling unit can include at lease one sensor mounted within the cabinet to generate an input signal corresponding to at least one parameter. The controller can be configured to receive the input signal from the at least sensor and log in the memory data corresponding to the at least one parameter of the input signal. The data corresponding to the at least one parameter of the input signal can be included in the logged data.

The sensor can be a door sensor and an at least one temperature sensor such as a thermistor. The door sensor can sense whether the door of the cooling unit is open. The temperature sensor can sense the temperature of the ambient air surrounding the temperature or the temperature of an object in thermal contact with the temperature sensor. A temperature sensor can be mounted in a refrigerator section to monitor the temperature of the refrigerator section. A temperature sensor can be mounted in the freezer section to monitor the temperature of the refrigerator section. A temperature sensor can be mounted to an ice mold of an ice maker to monitor the temperature of the ice mold. A temperature sensor can be mounted to an evaporator pan to monitor the temperature of the evaporator pan.

The logged data can include information about the compressor runtime, defrost length, actual temperature sensed by a temperature sensor, and sensor status.

A plurality of error conditions can be stored in the memory. The controller can compare the logged data to the plurality of error conditions to detect whether one of a plurality of error conditions has occurred. The controller can log in memory an error code corresponding to one of the plurality of error conditions when the one of the plurality of error conditions has been detected. A generic error indicator can be displayed when an error condition has been detected. A specific error indicator indicating the error code corresponding to the detected error condition can be displayed when a user selects to display the specific error indicator.

The error codes can indicate that a temperature sensor is open, a temperature sensor is shorted, a temperature sensor is out of range, a memory error has occurred, the door has been opened, and a pump circuit is open.

These and still other features of the invention will be apparent from the detailed description and drawings.

BRIEF DESCRIPTION OF THE DRAWINGS

FIG. 1 is a perspective view of a combination refrigerator/freezer unit having the features of the present invention;

FIG. 2 is a perspective view thereof similar to FIG. 1 albeit with its cabinet door open so that the interior of the cabinet is visible;

FIG. 14 is a table of input codes for the user interface control unit.

DETAILED DESCRIPTION OF THE PREFERRED EMBODIMENT

Figure 3:
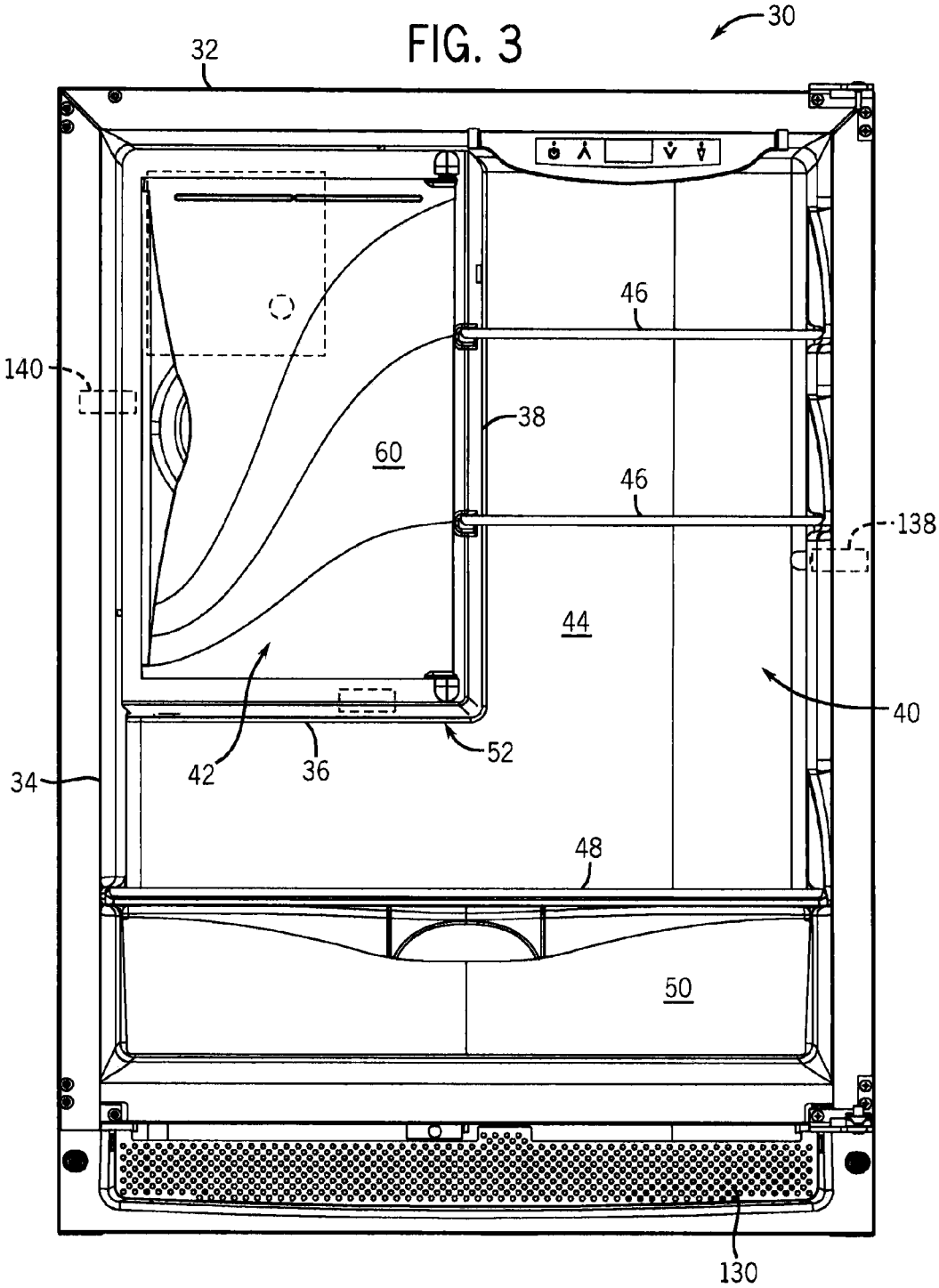
FIG. 3 is a front elevation view thereof with the cabinet door removed.

Referring to FIGS. 1-4, in one preferred form, a combination refrigerator/freezer unit 30 includes a cabinet 32 defining a cavity with a forward opening 34 that is divided by horizontal and vertical partition walls 36 and 38, respectively, into a refrigerator section 40 and an ice section 42. The refrigerator section 40 is an L-shaped chamber having a molded insert liner 44 with grooves that support shelves 46 (two are shown in the drawings). The shelves 46 are supported by corresponding grooves formed in the vertical partition wall 38. Molded insert liner 44 includes a pair of grooves that support a lower support shelf 48 and defines a recess for a crisper drawer 50. The ice section 42 is a rectangular chamber having a foam insulated, molded insert 52 containing a cube ice maker assembly 56 and an ice storage bin 58. The ice section 42 is closed by a door 60 that is hinged to insert 52 along one vertical side thereof. The cabinet opening 34 is closed by a door 64 that is hinged to the cabinet 32 (with self-closing cams) along one vertical side thereof. Both the cabinet 32 and the door 64 are formed of inner molded plastic members and outer formed metal members with the space filled in with an insulating layer of foam material, all of which is well known in the art. The door 64 has a handle (not shown) and can include one or more door shelves.

Figure 4:
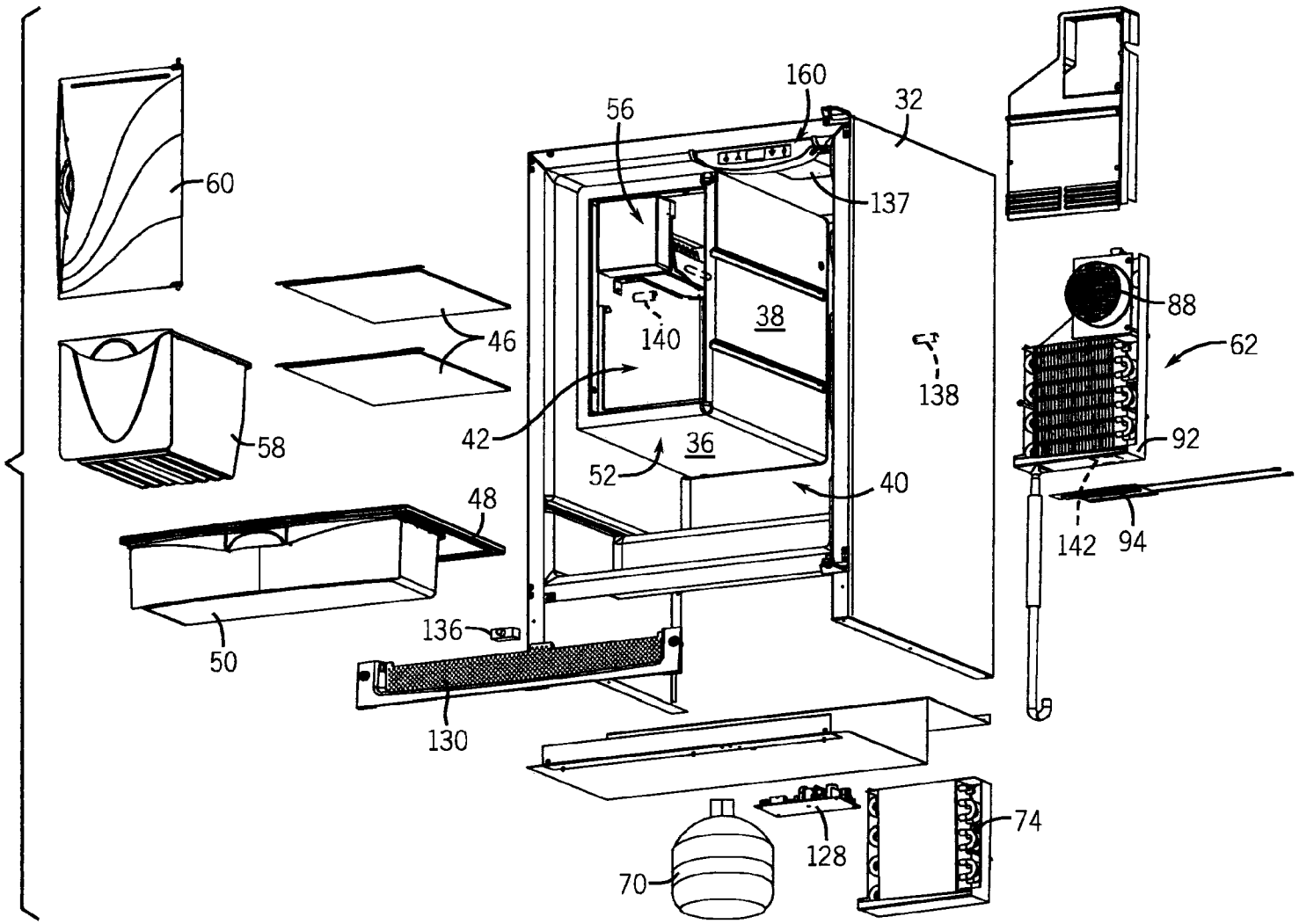
FIG. 4 is an exploded assembly view thereof.
Figure 12:
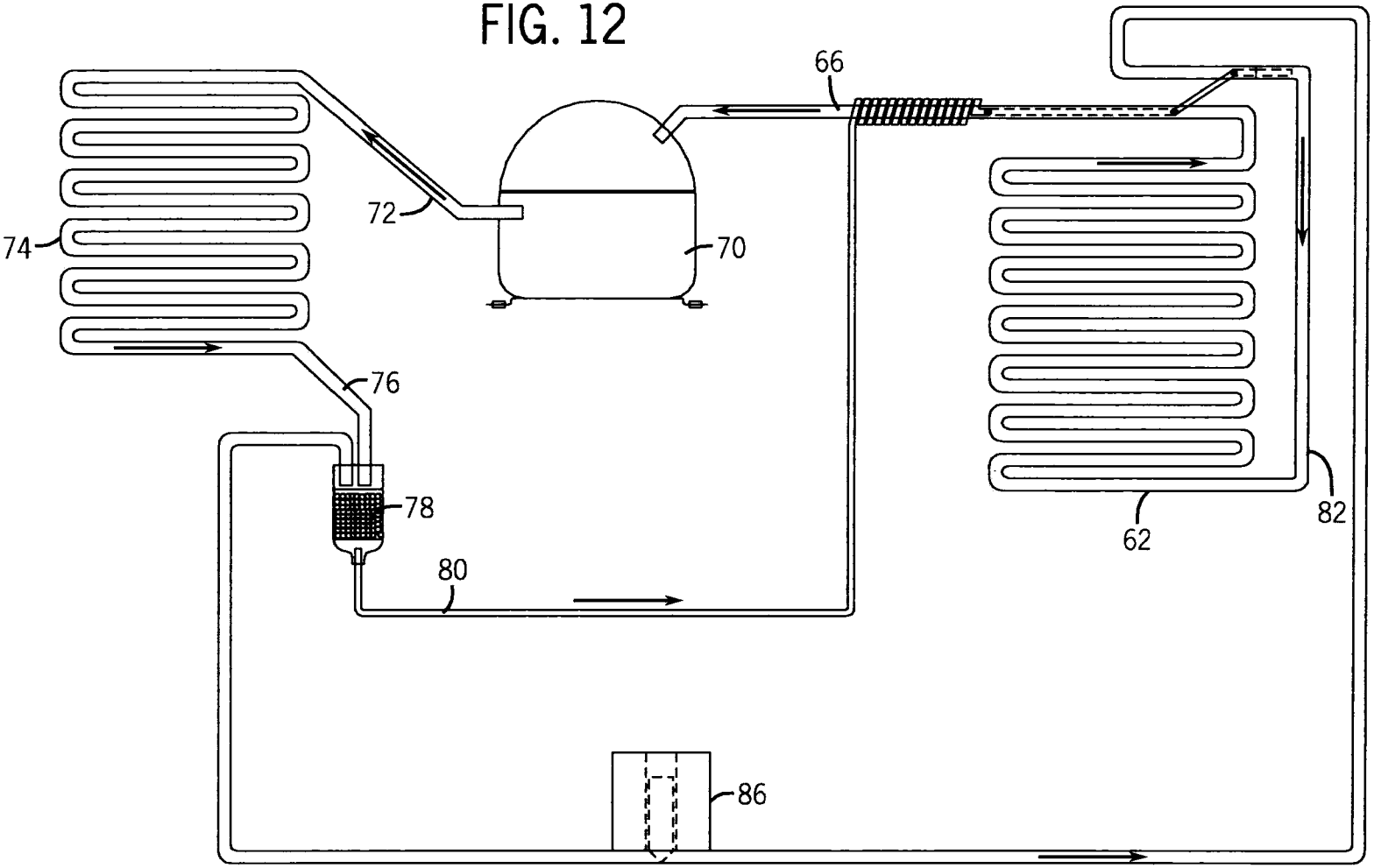
FIG. 12 is a diagram of the refrigeration system of the combination unit.

Along the back wall of the ice section 42 is an evaporator 62 with serpentine refrigerant tubes running through thin metal fins, which is part of the refrigeration system of the unit 30. With reference to FIGS. 4 and 12, the evaporator 62 has an outlet line 66 which is connected to the inlet of a compressor 70. A discharge line 72 connected to the outlet of the compressor 70 is connected to the inlet of a condenser 74 having an outlet line 76 connected to a dryer 78. A capillary tube 80 leads from the dryer 78 to an inlet line 82 of the evaporator 62. A bypass line 84 leads from the dryer 78 to the inlet line 82 of the evaporator. A hot gas bypass valve 86 controls communication between the dryer 78 and the evaporator 62. Bypass valve 86 can be an electronically controlled solenoid type valve. An evaporator fan 89 is positioned near the evaporator 62 and a condenser fan (90) is positioned near the condenser 74. An evaporator pan 92 is positioned beneath the evaporator 62 and is configured to collect and drain water. An evaporator pan heater 94 is beneath the evaporator pan 92 to heat the evaporator pan 92. The compressor 70, condenser 74 and condenser fan (see FIG. 13) are located at the bottom of the cabinet 32 below the insulated portion.

Figure 5:
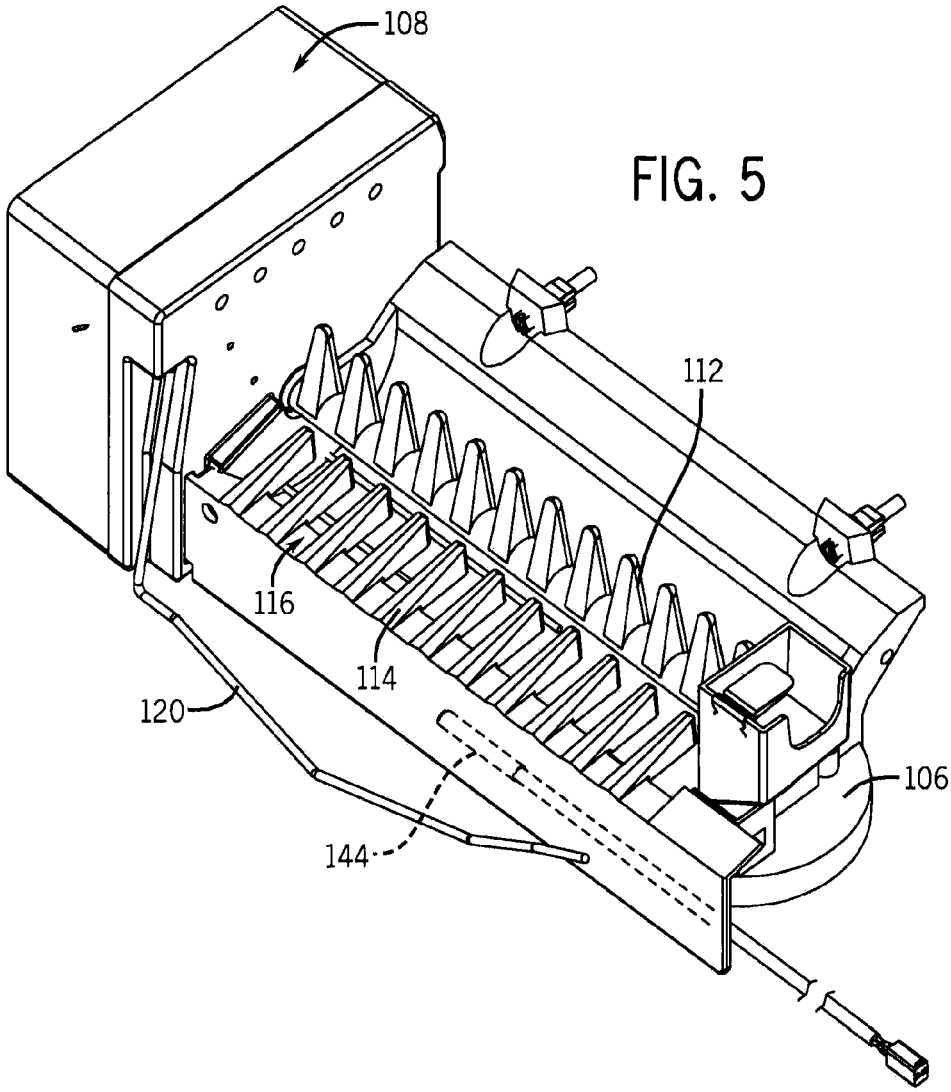
FIG. 5 is a perspective view of a cube ice maker assembly of the combination unit.
Figure 6:
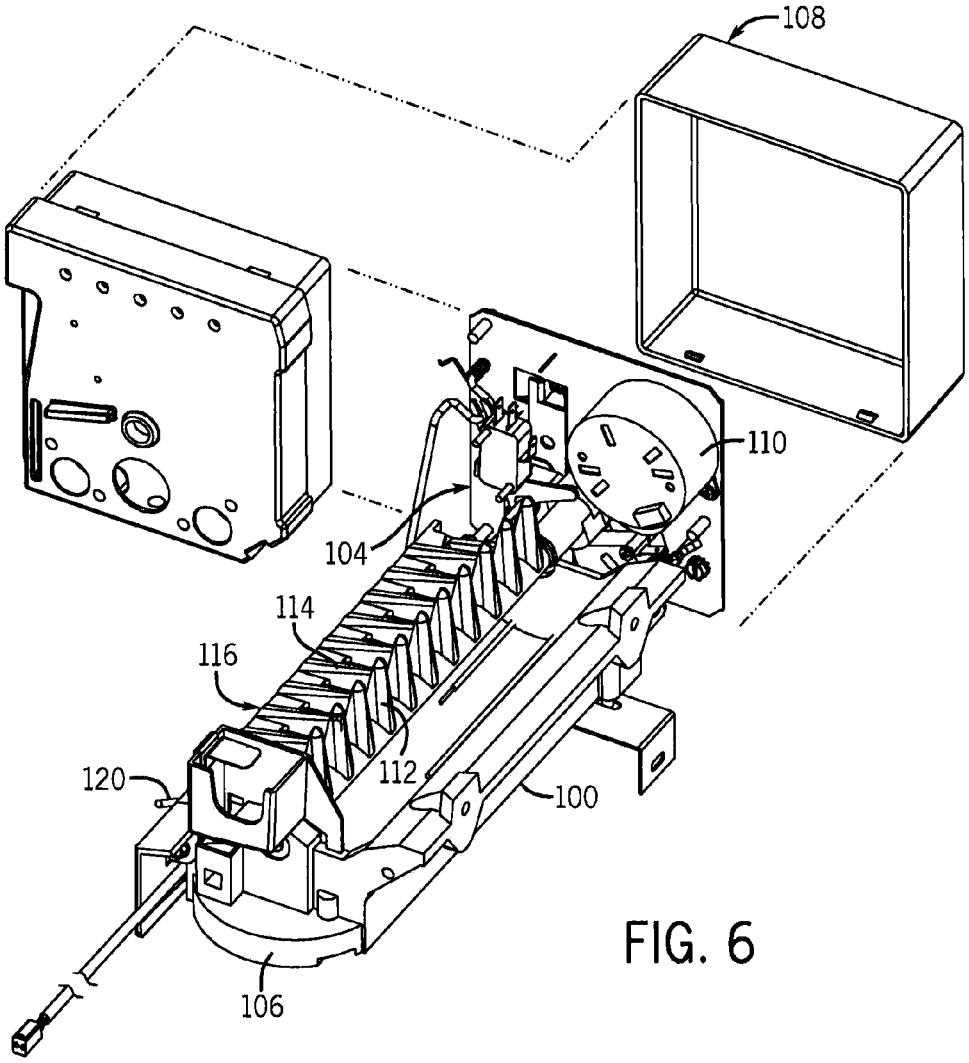
FIG. 6 is an exploded perspective view of the ice maker assembly.

Referring now to FIGS. 4-6, the cube ice maker assembly 56 is positioned in the upper part of the ice section 42 of the cabinet 32. The ice storage bin 58 is positioned in the lower part of the ice section 42 of the cabinet 32. The cube ice maker assembly 56 includes a housing 100, water inlet (not shown), drive assembly 104 and cube ice mold 106. The water inlet is connected to an electronic water valve 103 that controls the flow of water into the cube ice maker assembly 56. The water inlet is connected to a water transport mechanism (not shown) of the ice maker assembly 56 that transports water to the cavities of the cube ice mold 106 in order to fill the cube ice mold 106 with water when the electronic water valve 103 (see FIG. 13) is opened. The drive assembly 104 comprises a cover 108 that surrounds an electric motor 110. A plurality of ejector blades 112 are configured to be rotated by the electric motor 110 in order to engage ice formed in the cube ice mold 106 and carry the ice out of the cube ice mold 106, the ice stripped by a plurality of strippers 114 formed on a stripper plate 116, the ice dropping below into the ice storage bin 58. A mold heater 118 is in thermal communication with the cube ice mold 106 and is configured to provide heat to the cube ice mold 106 to loosen the ice from the cube ice mold 106 to aid the ejector blades 112 in ejecting the ice. A pivotably mounted ice level sensing arm 120 extends downwardly above the ice storage bin 58 to sense the level of the ice in the ice storage bin 58. Switches or sensors can be used to detect the position of the ejector blades 112 and/or motor 110 as well as the state of the cube ice maker assembly 56 (e.g., water fill, freeze and harvest stages).

Figure 13:
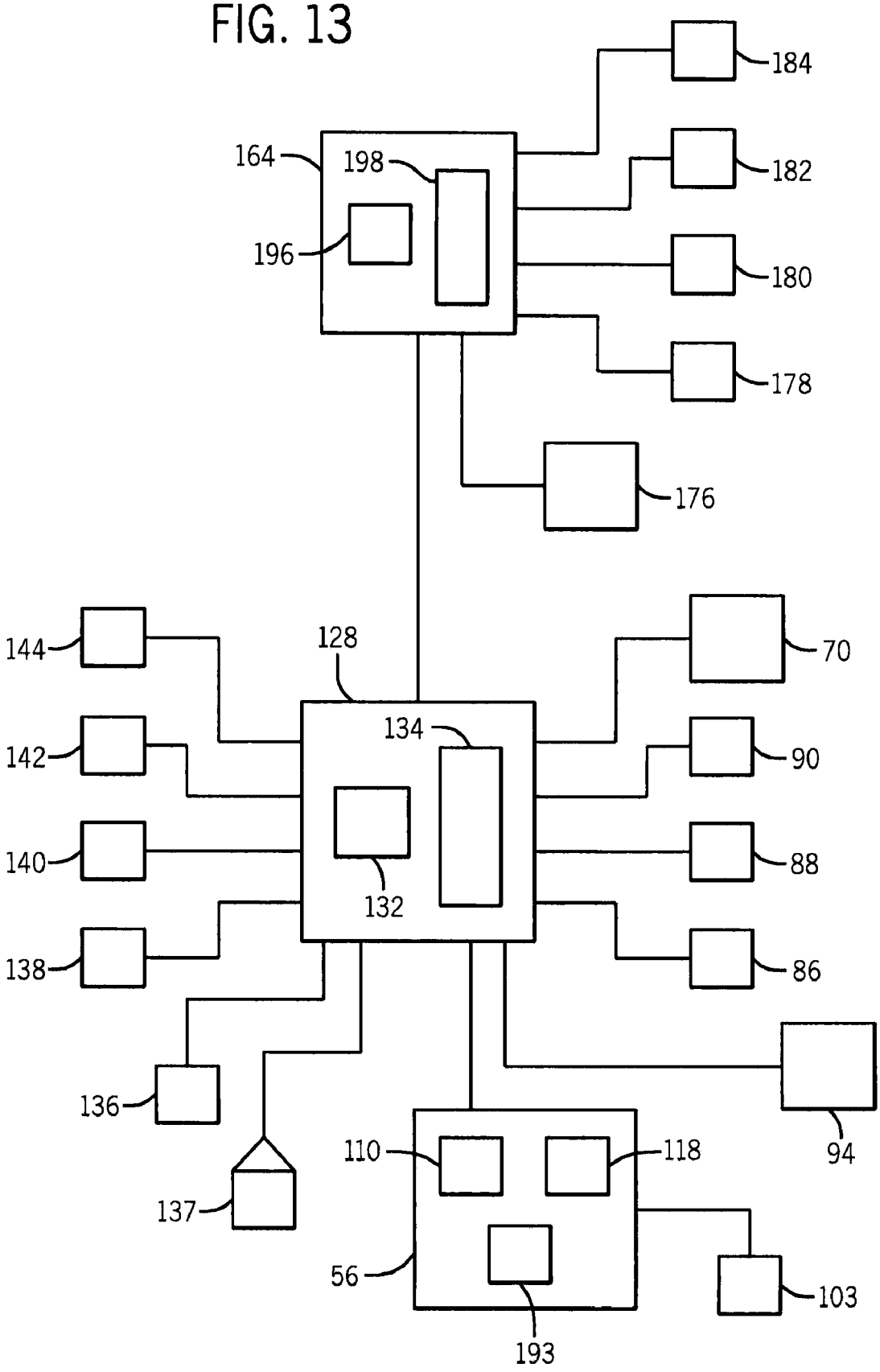
FIG. 13 is a block diagram of the control system of the combination unit.

Referring now to FIGS. 4 and 13, a controller 128 is attached below the cabinet and adjacent a kickplate 130 positioned below the cabinet door 64. The controller 128 comprises a microprocessor 132 that is connected to a memory 134. Alternatively, the microprocessor can include a memory. A plurality of connectors and lines (not shown) connect the controller 128 to sensors (discussed below) and relays associated with the other electrical components (not shown) of the refrigeration unit 30. A door sensor 136 is connected to the cabinet 32 adjacent to the door 64, the door sensor 136 configured to sense if the door 64 is opened or closed and to signal to the controller 128 whether the door 64 is opened or closed. The door sensor 136 can comprise a reed switch that senses a magnet (not shown) mounted on the door 64. A light 137 is mounted within the refrigerator section 40, the light 137 activated when the door sensor 136 senses that the door 64 is open. A refrigerator section temperature sensor 138 is attached to refrigerator section 40 (see FIGS. 3 and 4) and senses the temperature of refrigerator section and provides refrigerator section temperature information to the controller 128. An ice section temperature sensor 140 is attached to the ice section 42 (see FIGS. 3 and 4) and senses the temperature of the ice section 42 and provides ice section temperature information to the controller 128. An evaporator pan temperature sensor 142 is attached to the evaporator pan 92 (see FIG. 4) and senses the temperature of the evaporator pan 92 and provides evaporator pan temperature information to the controller 128. A cube ice mold temperature sensor 144 (see FIG. 5) is positioned within the cube ice mold 106 to measure the temperature of the cube ice mold 106 at a position adjacent to a cavity of the cube ice mold 106 where the ice is formed, the cube ice mold temperature sensor 144 providing cube ice mold temperature information to the controller 128 and/or to the cube ice maker assembly 56. The temperature sensors 138, 140, 142, and 144 can comprise thermistors or other appropriate temperature sensors. The controller 128 is configured to control refrigeration, ice making, defrost and other aspects of the refrigeration unit 30 as will be described hereinafter. The controller 128 is also configured to monitor data relating to the operation of the refrigeration unit 30 and to log the data in the controller memory 134 for access by a service technician as discussed hereinafter. The logged data can include error codes.

As is known, the compressor 70 draws refrigerant from the evaporator 62 and discharges the refrigerant under increased pressure and temperature to the condenser 74. The hot, pre-condensed refrigerant gas entering the condenser 74 is cooled by air circulated by the condenser fan 90. As the temperature of the refrigerant drops under substantially constant pressure, the refrigerant in the condenser 74 liquefies. The smaller diameter capillary tube 80 maintains the high pressure in the condenser 74 and at the compressor outlet while providing substantially reduced pressure in the evaporator 62. The substantially reduced pressure in the evaporator 62 results in a large temperature drop and subsequent absorption of heat by the evaporator 62. The evaporator fan 89 can draw air from inside the ice section 42 across the evaporator 62, the cooled air returning to the ice section 42 to cool the ice section 42. At least one air passage (not shown) connects the ice section 42 and the refrigerator section 40 so that the refrigerator section 40 is cooled by the ice section 42, the temperature of the refrigerator section 40 related to the temperature of the ice section 42. The compressor 70, condenser fan 90 and evaporator fan 89 are controlled by the controller 128 to maintain the ice section 42 at an ice section setpoint. The ice section setpoint is based on a refrigerator section setpoint (e.g., ice section setpoint is minus 30° Fahrenheit of the refrigerator section setpoint), the refrigerator section setpoint being inputted by a user as described below. The controller 128 logs the compressor runtime between defrost cycles and stores the compressor runtime in the controller memory 134.

As mentioned, the refrigeration system includes a hot gas bypass valve 86 disposed in bypass line 84 between the dryer 78 and the evaporator inlet line 82. Hot gas bypass valve 86 is controlled by controller 128. The evaporator 62 is defrosted for a defrost time up to a maximum defrost time after a certain amount of compressor runtime. When the hot gas bypass valve 86 is opened, hot pre-condensed refrigerant will enter the evaporator 62, thereby heating the evaporator 62 and defrosting any ice buildup on the evaporator 62. The evaporator pan heater 94 heats the evaporator pan 92 when the hot gas bypass valve 86 is opened so that ice in the evaporator pan 92 is melted at the same time that the evaporator 62 is defrosted. The hot gas bypass valve 86 and evaporator pan heater 94 are controlled by the controller 128 (i.e., the defrost cycle is controlled by the controller 128). The controller 128 logs the defrost runtime and stores the defrost runtime in the controller memory 134. The interval between defrost cycles can be adjusted by the controller 128.

The controller 128 can initiate an ice making cycle of the cube ice maker assembly 56 if the ice level sensing arm 120 does not prevent an ice making cycle from being initiated. Alternatively, the cube ice maker assembly 56 can initiate the ice making cycle if so authorized by the controller 128 and if the ice level sensing arm 120 does not prevent an ice making cycle from being initiated. The cube ice maker assembly 56 includes a microcontroller 193 that controls the operation of the ice maker assembly 56. The ice making cycle begins with filling of the cube ice mold 106 with water. The cube ice mold 106 can be heated by the mold heater 118 before water filling. The microcontroller 193 opens the water valve 103 thereby filling the cube ice mold 106 with an appropriate amount of water and then shuts off the water valve 103. The water is then frozen into cubes. The temperature of the cube ice mold temperature sensor 144 is monitored by the controller 128, the controller 128 initiating ice harvest when an ice mold temperature setpoint is reached (i.e., 15° Fahrenheit). Alternatively, the microcontroller 193 could monitor the temperature of the cube ice mold 106 and decide when to initiate ice harvest. During ice harvest, the microcontroller 193 causes the mold heater 118 (see FIG. 13) to heat the cube ice mold 106 and causes the ejector blades 112 to rotate thereby pushing the ice out of the cube ice mold 106 and into the ice storage bin 58. Limit switches can monitor when the ejector blades 112 have fully rotated so that another ice making cycle can be initiated if the ice level sensing arm 120 does not sense that the ice storage bin 58 is full of ice. The compressor 70 can be on or off during the freezing and harvest stages of the ice making cycle and should be off during the water fill stage.

Figure 7:
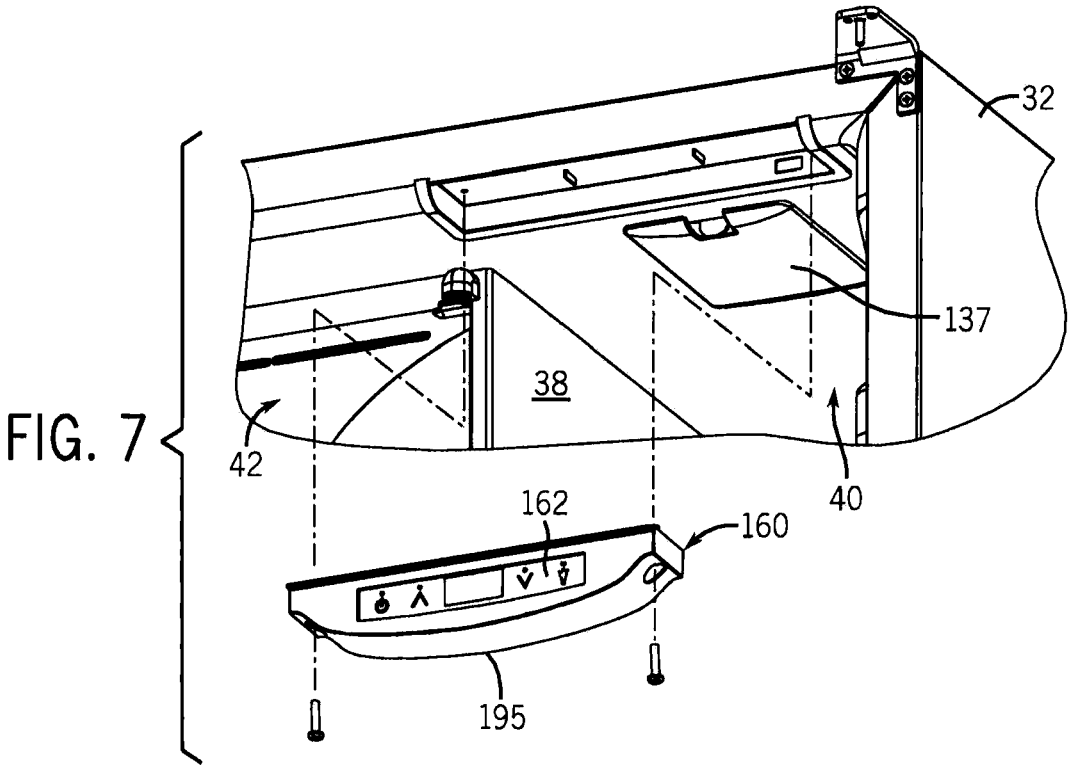
FIG. 7 is a partial exploded perspective view showing the user interface control unit.
Figure 8:
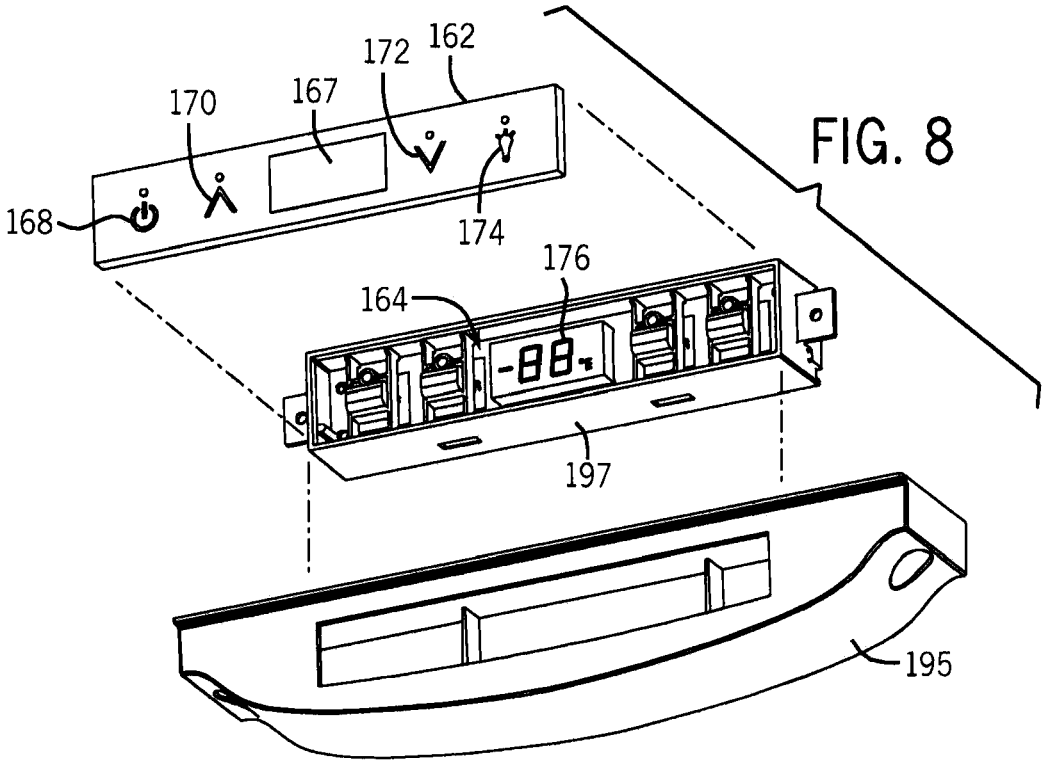
FIG. 8 is an exploded assembly of the user interface control unit.
Figure 9:
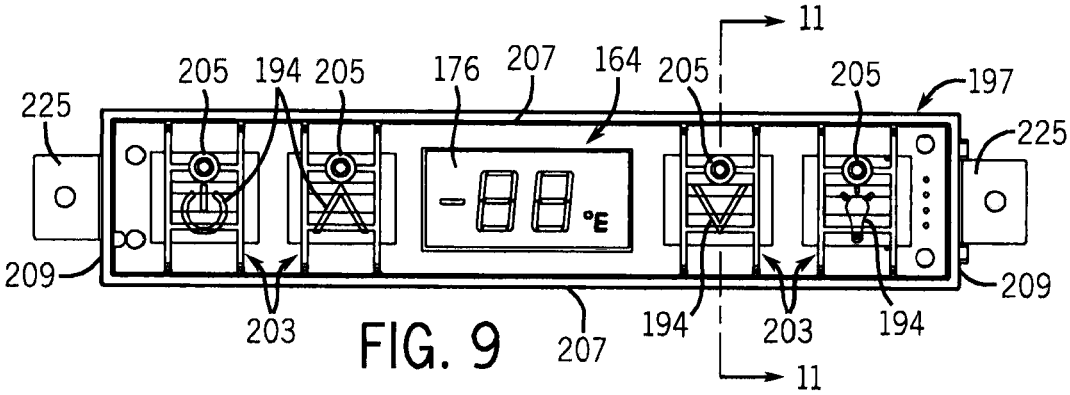
FIG. 9 is a front elevational view of the control board and mount thereof.
Figure 11:
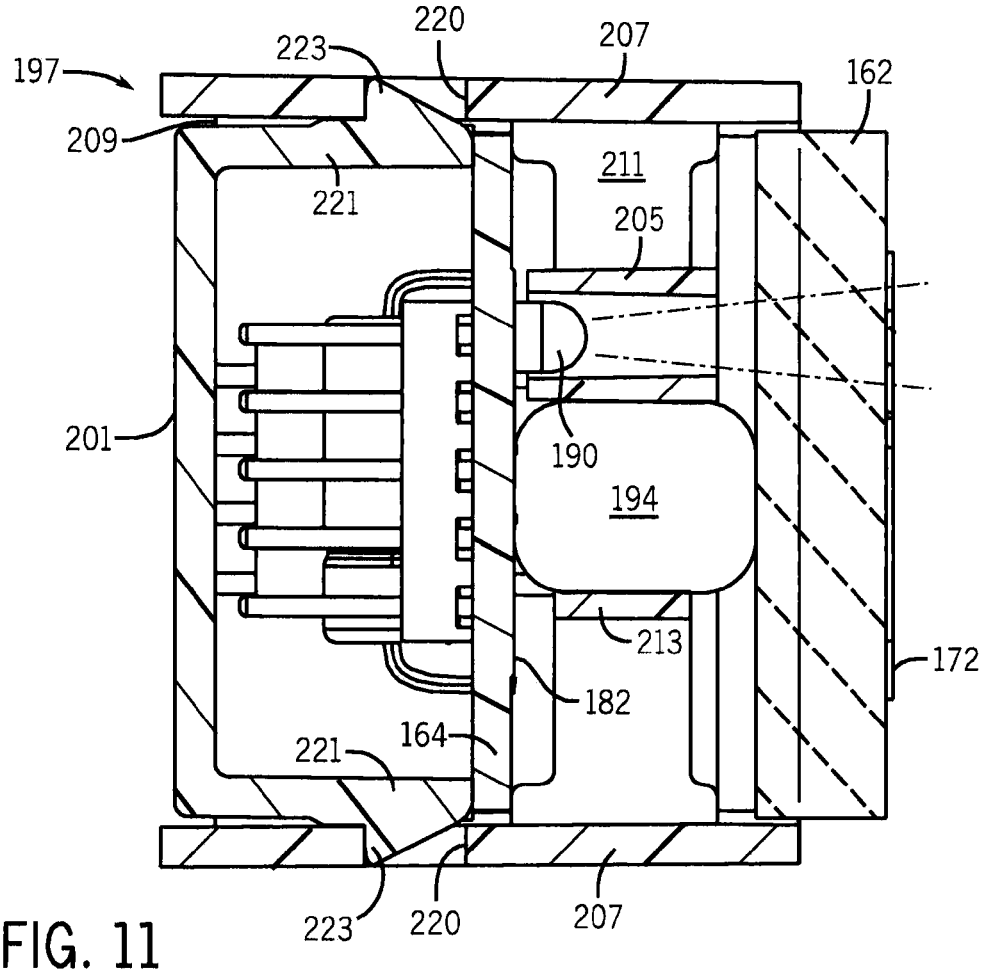
FIG. 11 is a sectional view taken along line 11-11 of FIG. 9.
Figure 10:
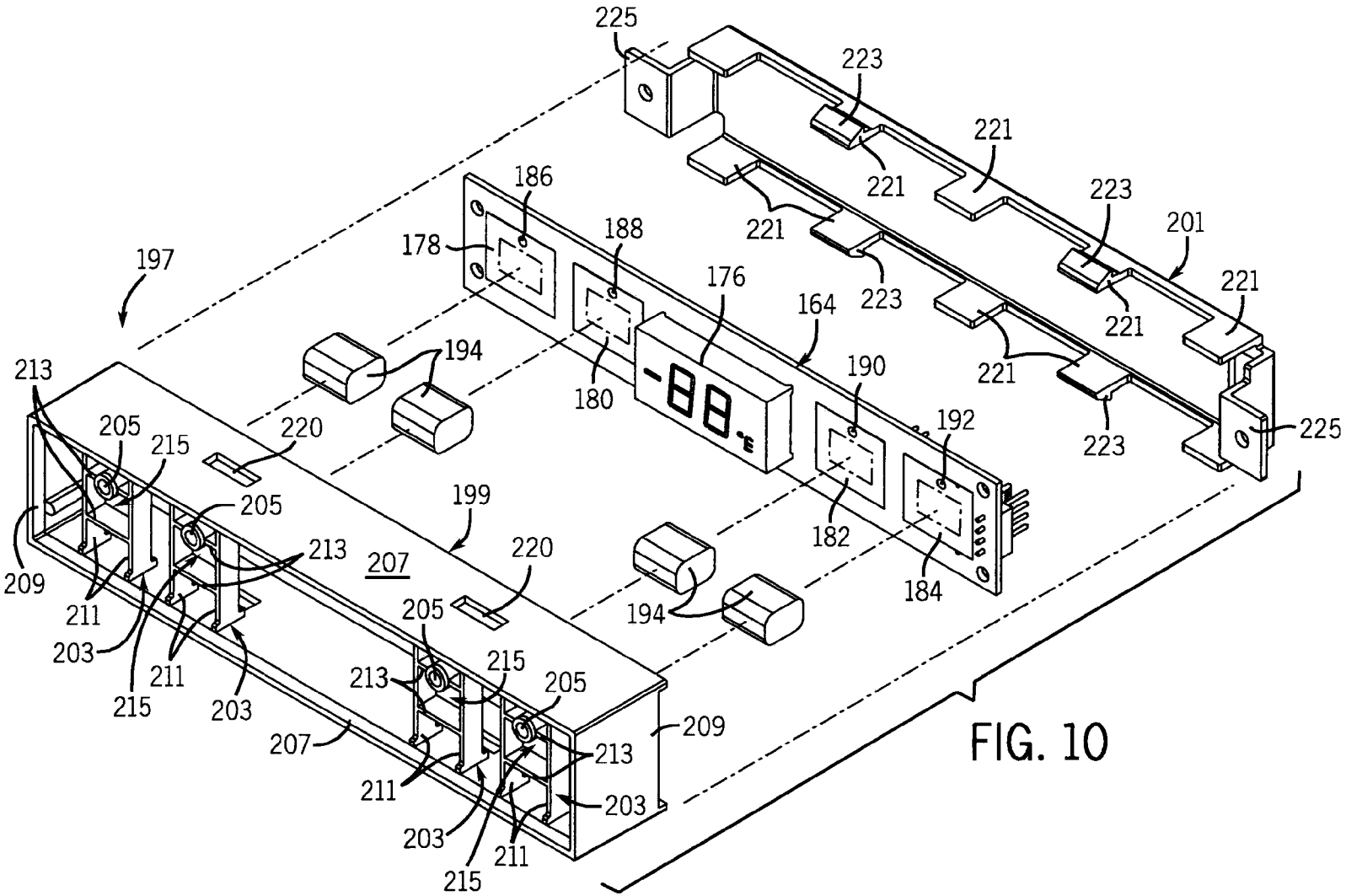
FIG. 10 is an exploded perspective view of the control board and mount.

Referring now to FIG. 7, a user interface control unit 160 is mounted to the top of the refrigerator molded insert liner 44 within the cabinet 32 for receiving user commands and forwarding input signals to the main controller 128. The control unit 160 includes a display panel 162 and an input control board 164. The display panel 162 has a translucent display window 167, having power indicia 168, a warmer indicia 170, a cooler indicia 172 and a light indicia 174. The control board 164 includes an electronic display 176, a power switch 178, a warmer switch 180, a cooler switch 182, a light switch 184 and a plurality of LEDs 186, 188, 190, and 192, associated with the switches, respectively. The display panel window 166 is positioned in front of the display 176 on the control board 164 and allows for a user to view whatever is displayed on the display 176. The power indicia 168, warmer indicia 170, cooler indicia 172 and light indicia 174 are positioned in front of the power switch 178, warmer switch 180, cooler switch 182, and light switch 184, respectively. The switches 178, 180, 182, and 184 comprise capacitive proximity sensors which include flexible extension pads 194 positioned adjacent the corresponding indicia 168, 170, 172, and 174. The pads 194 are preferably adhered to the conductive contacts of the switches on the control board 164 and touch against the back side of the display panel 162. The pads 194 are made of foam cores encased in conductive fabric that provides an electrical pathway from the switch contact on the control board 164 to the display panel 162.

Referring to FIGS. 8-11, the display panel 162 and the control board 164 are mounted inside of an outer control housing 195 via mount 197. The mount 197 has two parts, a main housing 199 and a back cover 201. The housing 199 is a monolithic structure formed of a molded plastic to include a plurality of integral switch supports 203 and light guides 205 as a single unitary part, four of each are shown. The housing has pairs of long 207 and short 209 outer walls that form the perimeter of the mount 197 framing the control board 164. The long walls 207 have two slots 220 therein for attaching the back cover 201. The switch supports 203 span the long walls 207 with their two spaced apart bridge walls 211 across which extend two spaced apart cross walls 213. The intersection of these walls 211 and 213 form a generally square opening 215 which surrounds each flexible extension pad 194 to restrain it from excessive lateral movement that could cause it to lose contact with the control board 164 and the display panel 162. The light guides 205 are cylindrical walls that intersect the upper cross wall of each switch support 203.

While the disclosed embodiment shows square openings 215 and cylindrical light guides 205, other suitable configurations could be used provided the extension pads 194 are adequately supported at their sides and light from the LEDs 186, 188, 190 and 192 is effectively isolated from the interior of the housing 199 and directed from the control board 164 to the associated indicia of the display panel 162 to illuminate the indicia.

The outer side of the switch supports 203 and light guides 205 are generally co-planar and recessed back from the front plane of the housing 199 so that the display panel 162 can be recess mounted inside the front opening for the housing 199 and be supported at its back side by the switch supports 203 and the light guides 205. The back side of the switch supports 203 extend to a plane that extends into the housing 199 a lesser distance than does the back side of the light guides 205. This helps ensure that the light guides 205 extend down against the control board 164 to better surround the LEDs 186, 188, 190 and 192 to prevent light from leaking around the light guides 205.

The control board 164 is secured into the housing 199 by tabs 221 on the back cover 201 that extend into the housing 199, and contact the back side of the control board 164 to apply a clamping force holding the control board 164 against the light guides 205, thus securing the position of the control board 164 and further reducing the chance of light leaking around the light guides 205. Four of the tabs 221 have catches 223 that engage the slots 220 in the long walls 207 of the housing 199 to attach the back cover 201. The back cover 201 also has two ears 225 with openings therein that provide for mounting of the mount to a support surface, such as the outer control housing 195. The display panel 162 is secured within the housing 199 by abutment with the front wall of the outer control housing 195.

The switches 178, 180, 182 and 184 are each configured to independently sense when they are activated by a user. In order to simplify discussion of the operation of the switches 178, 180, 182 and 184, activation of a switch will be described as touching and/or holding of the indicia on the display panel 162 associated with one of the switches 178, 180, 182 and 184 which is then activated by a change in capacitance, or upon reaching a certain threshold level of capacitance.

The control board 164 further includes an input processor 196 connected to the controller 128 and to the display 176; switches 178, 180, 182, and 184; and LEDs 186, 188, 190, and 192. The input processor 196 is connected to a memory 198. Alternatively, the input processor 196 can include a memory. The input processor 196 receives signals from the switches 178, 180, 182 and 184 when the switches 178, 180, 182 and 184 are touched. Additionally, when one of the switches 178, 180, 182, and 184 is touched, the corresponding LED 186, 188, 190, or 192 is lit and a beep sound is produced by at least one sound component (not shown) mounted to the controller 128 and/or control unit 160. The input processor 196 is connected to the controller 128 and the controller 128 controls what is displayed on display 176.

The input processor 196 receives a power signal 200, a warmer signal 202, a cooler signal 204, and a light signal 206 when switches 178, 180, 182 and 184, respectively, are touched and/or held. The input processor 196 can determine if the switches 178, 180, 182 and 184 are touched or held, and can determine the length of the hold. The input processor 196 analyzes a sequence and/or combination of signals 200, 202, 204, and 206 as a coded input 208. The input processor 196 decodes the coded input 208 and provides an input command 210 to the controller 128. The input processor memory 198 includes the coded inputs 208. The controller 128 then performs a controller operation corresponding to the input command 210. The controller operations and input commands 210 are stored in the controller memory 134.

FIG. 14 shows coded inputs 208 and their corresponding input commands 210. Note that the input commands include commands for cooling units including various combinations of at least one refrigerator section, a cube ice maker, a clear ice maker, and a freezer section. Holding the power switch 178 for ten seconds corresponds to a power command that will cause the display to turn on and off. Touching the light switch 184 one time corresponds to a light toggle command that causes the light mode to be toggled (i.e., light 137 on/off when a glass door is opened/closed or light 137 on all the time). Holding the warmer switch 180 for five seconds corresponds to a view actual temperature of the temperature sensor 138 command that causes the actual temperature of the temperature sensor 138 being displayed on display 176. Holding both the warmer switch 180 and the cooler switch 182 corresponds to a view actual temperature of the other temperature sensors command that results in the actual temperature of the temperatures sensors 140, 142 and 144 being scrolled on the display 176. Holding the light switch 184 while touching the cooler switch 182 three times corresponds to a toggle temperature units command that results in toggling the temperature units used (i.e., Celsius or Fahrenheit). Holding the cooler switch 182 while touching the light switch 184 three times corresponds to a turn showroom mode on command that results in enabling the showroom mode. Holding the warmer switch 180 while touching the power switch 178 three times causes the display mode to be toggled (i.e., display 176 and/or LEDs 186, 188, 190, or 192 on/off when a glass door is opened/closed). Holding the light switch 184 for ten seconds corresponds to a blackout mode command that results in light 137, display 176, and LEDs 186, 188, 190, or 192 being turned off for 36 hours or until light switch 184 is again held for ten seconds. Holding the power switch 178 while touching the light switch 184 three times corresponds to a cleaning mode command the results in running the cleaning mode for cooling units with clear ice cube makers. Holding power switch 178 while touching the warmer switch 180 three times corresponds to an icemaker on/off command that results in turning the ice maker assembly 56 on and off. Holding the power switch 178 while touching the cool switch 182 corresponds to a forced harvest command that results in a forced harvest of the ice in the ice maker assembly 56. Holding the light switch 184 while touching the power switch 178 three times corresponds to a forced defrost command that results in a forced defrost of the refrigeration system. Holding the cooler switch 182 while touching the warmer switch 180 three times corresponds to a temporary shutdown command that results in a temporary shutdown of the cooling unit 30 for three hours. Holding the cooler switch 182 while touching the power switch 178 three times corresponds to a relay status command that results in the status of the relays being scrolled on the display 176 (i.e., single digit relay number and 1/0 for on/off).

Depending on the input command 210, after an input command 210 has been sent to the controller 128, the input processor 196 can wait for further signals from the switches 178, 180, 182 and 184 and then decode or directly send a corresponding further input command to the controller 128. For example, once an input command 210 has been sent to the controller 128, touching the temperature adjustment switches 180 and 182 can scroll through a displayed menu of menu options and touching the light switch 184 can select the menu option currently displayed (i.e., the light switch 184 acts as a return or enter key). Holding the warmer switch 180 while touching the light switch 184 three times corresponds to a service mode command which results in a service mode menu list to be displayed on the display 176 as discussed below. Touching one of the temperature adjustment switches 180 and 182 corresponds to a cooling unit setpoint set mode command that causes the input processor 196 to send temperature adjustment command signals to the controller 128 when the temperature adjustment switches 180 and 182 are touched thereafter so that the refrigerator unit setpoint can be set by a user by scrolling to a setpoint and selecting the setpoint. Holding the warmer switch 180 while touching the cooler switch 182 corresponds to an ice thickness adjustment command that allows for an ice thickness of clear ice to be selected by scrolling to an ice thickness and selecting the ice thickness. Holding each of the warmer switch 180, cooler switch 182, and light switch 184 while a jumper (not shown) is placed on the controller 128, corresponds to a change model number command that allows for changing the model number by selecting a model scrolled on the display 176.

The service mode input command causes the controller 128 to execute a service mode operation that causes the display of service mode menu options on the display 176. Examples of service mode menu options are summarized in TABLE 1 below.

TABLE 1

Service Mode Menu Options

| Option Number | Description |
|---|---|
| 1 | Light all LED Segments |
| 2 | Temperature sensor #1 status (Temp, E1 or E2) |
| 3 | Error log |
| 4 | Defrost info |
| 5 | Compressor runtime (based on last cycle) |
| 6 | Defrost Length (adjustment - up to 99 minutes |
| 7 | Light switch status (0 or 1) |
| 8 | Display toggle status (0 or 1) |
| 9 | Restore factory defaults |
| 10 | Adjust temperature sensor #1 offset (−10 to +10) |
| 11 | Data download |
| 12 | Clear error log |
| 13 | Clear download memory |
| 14 | Model number display |
| 15 | Adjust temperature sensor #1 differential |
| 16 | Adjust temperature sensor #2 offset |
| 17 | Adjust temperature sensor #3 offset |
| 18 | Adjust temperature sensor #4 offset |
| 19 | View temperature sensor #2 status |
| 20 | View temperature sensor #3 status |
| 21 | View temperature sensor #4 status |
| 22 | Automatic toggle through relays (switch on or off) |
| 23 | Defrost interval adjust (3 to 24 hours) |
| 24 | Adjust temperature sensor #2 setpoint |
| 25 | Adjust temperature sensor #3 setpoint |
| 26 | Adjust temperature sensor #4 setpoint |
| 27 | Display software version |
| 99 | Exit Service Mode |

A service technician can scroll through the service menu option numbers by touching temperature adjustment switches 180 and 182 and select the option displayed in the display 176 by touching the light switch 184. The service technician can select a service mode menu option that will result in the display of cooling unit operational data that has been logged by the controller 128 (e.g., temperature sensor status/temperature, defrost information, compressor runtime, light switch status). The operational data is sensed by sensors and/or the controller 128 and logged by the controller 128 in the controller memory 134. Other service menu options will result in the controller 128 performing a function (e.g., light all LEDs, restore factory defaults, clear error log, clear download memory, automatic toggle through relays). Additionally, the selected service mode menu option may require further input from the service technician, and the service technician can touch and/or hold the switches 178, 180, 182 and 184 to provide that input. For example, the service technician can select the defrost length service mode menu option and then set the length of the defrost cycle which is saved into controller memory 134. The service technician can also adjust temperature sensor setpoints, offsets and differential.

The service technician can also select the error log service mode menu option and the error codes stored in the controller memory 134 will be displayed on the display 176. The service technician may choose to view the error codes displayed in the memory because the controller 128 displays a generic error indicator (not shown) on the display 176 when an error has been detected and an error code logged. The generic error indicator does not indicate the specific error code (e.g., the generic error code can be "Er"). The service technician can scroll through the error codes from the most recent error code to the last error code by touching temperature adjustment switches 180 and 182. Alternatively, the error codes can be scrolled in sequence automatically by the controller 128. Examples of error codes are summarized below in TABLE 2. The summary of error codes includes error codes for cooling units including various combinations of at least one refrigerator section, a cube ice maker, a clear ice maker, and a freezer section.

TABLE 2

| Error Code | Description |
|---|---|
| E1 | Temperature Sensor #1 open |
| E2 | Temperature Sensor #1 shorted |
| E3 | Door #1 open longer than 20 minutes |
| E5 | Temperature Sensor #1 out of range (+10) for more than 12 hours |
| E6 | Temperature Sensor #1 out of range (−10) for more than 12 hours |
| E7 | Temperature Sensor #2 open or shorted |
| E8 | Temperature Sensor #3 open or shorted |
| E9 | Temperature Sensor #4 open or shorted |
| E10 | Door #2 (drawer) open longer than 20 minutes |
| E11 | EE Memory Error |
| P1 | Pump circuit open due to high water level in ice bin |

The service technician can view the error code displayed on the display 176 and determine the corresponding error. The error codes are generated by controller 128 when an error condition has been detected. The error conditions are stored in the controller memory 134. One error code is a door open error code that is detected and logged when the controller 128 determines that the door 64 has been open for longer than a period of time stored in memory (e.g., twenty minutes), the controller 128 also producing an error message on the display 176 and generating an audible alert. Other error codes relate to the temperature sensors 138, 140, 142, and 144, the controller 128 monitoring and storing error codes when a temperature sensor is open, shorted, or out of range for a period of time. Other components of the cooling unit 30 can be monitored by the controller 128 and error codes can be logged by the controller 128 when an error has been detected.

The controller 128 can include a connector (not shown) to which a service technician can connect a computer. The functions of the controller 128 can be accessed through the computer and the computer can download the data logged by the controller 128 (e.g., set point, average temp, minimum temperature, maximum temperature and compressor runtime for each hour during the previous seven days). The connector is a serial interface and a power isolation device that allows the computer to be connected to the controller 128 without damaging the computer. Additionally, the controller 128 has a live data mode during which the computer can receive live data from the controller 128. Every minute, the controller 128 outputs various operational parameters (e.g., the set points, actual temperatures, differentials, offsets, relay statuses, compressor status, compressor runtimes, defrost timer, defrost duration, number of defrost cycles, ice cycle time, ice thickness and door status). The stored data and live data help a service technician to diagnosis the source of a problem.

It should be appreciated that merely a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

We claim:

1. A cooling unit, comprising:

a cabinet providing at least one cooling chamber therein;

a refrigeration system including an evaporator, a compressor receiving return refrigerant from the evaporator, a condenser coupled to the compressor and to the evaporator through a restriction; and a controller for controlling the cooling unit, the controller having a memory, a processor and an output interface, the controller being configured to monitor at least one parameter of the cooling unit, log in the memory data corresponding to the at least one parameter, and output the logged data via the output interface;

at least one sensor mounted within the cabinet to generate an input signal corresponding to at least one parameter;

wherein the controller is configured to receive the input signal from the at least sensor and log in the memory data corresponding to the at least one parameter of the input signal thereby including the plurality of data corresponding to the at least one parameter of the input signal in the logged data, wherein a plurality of error conditions are stored in the memory and the controller is configured to compare the logged data to the plurality of error conditions to detect whether one of a plurality of error conditions has occurred and log in the memory an error code corresponding to one of the plurality of error conditions when the one of the plurality of error conditions has been detected, and wherein the controller is configured to output a generic error indicator via the output interface when the error code is logged in the memory.

2. The cooling unit of claim 1, wherein the controller is configured to output the error code via the output interface in response to a user input signal.

3. The cooling unit of claim 2, wherein the error code is one of a temperature sensor error code, a door open error code, a memory error code, and a pump error code.

4. The cooling unit of claim 3, wherein the temperature sensor error code indicates that a temperature sensor is one of open, shorted and out of range.

5. The cooling unit of claim 1, wherein the logged data includes one of a compressor runtime, a defrost runtime, a temperature sensor status and a sensed temperature.

6. The cooling unit of claim 1, wherein the at least one sensor is a temperature sensor and the at least one parameter of the input signal is a temperature adjacent the temperature sensor.

7. The cooling unit of claim 1, the cooling unit further comprising a door, wherein the at least one sensor is a door sensor configured to sense whether the door is open.

8. A cooling unit, comprising:

a cabinet providing at least one cooling chamber therein;

a refrigeration system including an evaporator, a compressor receiving return refrigerant from the evaporator, a condenser coupled to the compressor and to the evaporator through a restriction;

at least one temperature sensor mounted within the cabinet generate an input signal corresponding to at least one temperature of the refrigeration system; and a controller for controlling the refrigeration system and being electrically coupled to the at least one temperature sensor, the controller having a memory, a processor and an output interface, the controller being configured to receive the input signal from the at least one temperature sensor, log in the memory data corresponding to the at least one temperature of the input signal, and output the logged data via the output interface, wherein a plurality of error conditions are stored in the memory and the controller is configured to compare the logged data to the plurality of error conditions to detect whether one of a plurality of error conditions has occurred and log in the memory an error code corresponding to one of the plurality of error conditions when the one of the plurality of error conditions has been detected;

wherein the controller further comprises a user input configured to generate a user input signal, wherein the controller is configured to receive the user input signal and output the error code via the output interface only after receiving the user input signal.

9. The cooling unit of claim 8, wherein there are a plurality of temperature sensors that each generate an input signal corresponding to at least one temperature of the refrigeration system.

10. The cooling unit of claim 8, wherein the logged data includes a controller configured to output the logged data to a computer.

11. The cooling unit of claim 8, wherein the controller is configured to output the logged data to a computer.

12. The cooling unit of claim 8, wherein the at least one temperature sensor is a thermistor and the error code is one of thermistor open, thermistor shorted and thermistor out of range.

* * * * *